US008657135B2

(12) United States Patent
Yamashita et al.

(10) Patent No.: US 8,657,135 B2
(45) Date of Patent: Feb. 25, 2014

(54) ARTIFICIAL NIPPLE AND NURSING CONTAINER USING SAME

(75) Inventors: Daisuke Yamashita, Tokyo (JP); Norio Kimura, Tokyo (JP); Masakazu Yoshida, Tokyo (JP); Mitsuo Tashiro, Tokyo (JP)

(73) Assignee: Pigeon Corporation, Tokyo (JP)

( * ) Notice: Subject to any disclaimer, the term of this patent is extended or adjusted under 35 U.S.C. 154(b) by 0 days.

(21) Appl. No.: 13/505,155

(22) PCT Filed: Oct. 29, 2010

(86) PCT No.: PCT/JP2010/006406

§ 371 (c)(1),
(2), (4) Date: Jun. 25, 2012

(87) PCT Pub. No.: WO2011/052229

PCT Pub. Date: May 5, 2011

(65) Prior Publication Data

US 2012/0267334 A1 Oct. 25, 2012

(30) Foreign Application Priority Data

Oct. 30, 2009 (JP) ..... 2009-250881

(51) Int. Cl.
*A61J 9/04* (2006.01)
*A61J 11/02* (2006.01)

(52) U.S. Cl.
CPC ... *A61J 9/04* (2013.01); *A61J 11/02* (2013.01)
USPC ..... 215/11.5

(58) Field of Classification Search
CPC ..... A61J 9/04; A61J 11/02
USPC ..... 215/311, 307, 200; 220/203.29, 203.19, 220/714, 711
IPC ..... A61J 9/04, 11/02, 11/04
See application file for complete search history.

(56) References Cited

U.S. PATENT DOCUMENTS 2,616,581 A * 11/1952 Madsen et al. ..... 215/11.5
3,593,870 A * 7/1971 Anderson ..... 215/11.5
4,993,568 A * 2/1991 Morifuji et al. ..... 215/11.1

(Continued)

FOREIGN PATENT DOCUMENTS

JP 54-131469 A 10/1979
JP 2001-204796 A 7/2001

(Continued)

OTHER PUBLICATIONS

Translation of JP 2006006809 (Tashiro et al.), Jan. 12, 2006, Paragraphs 23 and 27.*
International Search Report for PCT/JP2010/006406 dated Dec. 7, 2010.

*Primary Examiner* — Robert J Hicks
(74) *Attorney, Agent, or Firm* — Kenealy Vaidya LLP

(57) ABSTRACT

An artificial nipple can include a nipple tip section that can sufficiently reach the sucking fossa and can be appropriately squashed The artificial nipple can have a base section that widens to match an attachment object, an areola section formed contiguously to the base section and that extends while narrowing gradually, and a nipple section that extends from the areola section and that narrows more than the areola section. A flange section can be provided in the base section with a predetermined thickness. A check valve can be formed with a valve body so as to be entirely accommodated within the thickness dimension of the flange, and provided in the base section.

18 Claims, 10 Drawing Sheets

(56) References Cited

U.S. PATENT DOCUMENTS

| | | | | |
|---|---|---|---|---|
| 5,474,028 | A * | 12/1995 | Larson et al. | 119/71 |
| 5,881,893 | A * | 3/1999 | Manganiello | 215/11.5 |
| 6,994,225 | B2 * | 2/2006 | Hakim | 215/11.4 |
| 2005/0252875 | A1 | 11/2005 | Sheu et al. | |
| 2008/0210655 | A1 | 9/2008 | Rees et al. | |
| 2010/0163508 | A1 | 7/2010 | Samson | |

FOREIGN PATENT DOCUMENTS

| | | | |
|---|---|---|---|
| JP | 2006-6809 | A | 1/2006 |
| JP | 2008-504095 | A | 2/2008 |
| JP | 2008-534101 | A | 8/2008 |

* cited by examiner

ARTIFICIAL NIPPLE AND NURSING CONTAINER USING SAME

TECHNICAL FIELD

This application is a U.S. national phase filing under 35 U.S.C. §371 of PCT Application No. PCT/JP2010/006406, filed Oct. 29, 2010, and claims priority under 35 U.S.C. §119 to Japanese patent application no. 2009-250881, filed Oct. 30, 2009, the entireties of both of which are incorporated by reference herein.

The presently disclosed subject matter relates to an artificial nipple that is used in a nursing container, and to a nursing container that is provided with the artificial nipple.

BACKGROUND ART

Conventional artificial nipples, which are attached to a bottle that holds milk or breast milk collected beforehand, are widely used.

In particular, an infant suctions milk that is held in a nursing container through sucking on an artificial nipple, upon lactation out of a nursing container. As a result, the milk volume decreases, and the pressure in the bottle drops proportionally. Milk becomes thus harder to suction, and negative pressure causes the artificial nipple to collapse.

Therefore, some instances of artificial nipples are found (Patent Literature 1, FIG. 2; Patent Literature 2, FIG. 2) in which downwardly-protruding valve bodies are provided at a flange section of a base section at the lower end of the artificial nipple, so that the valve bodies form a check valve that leads external air into the bottle.

CITATION LIST

Patent Literature

Patent Literature 1: US 2005/0252875 A1
Patent Literature 2: JP 2006-6809 A

SUMMARY

In Patent Document 1, however, valve bodies are provided exposed below a flange section of the artificial nipple, and hence the valve bodies are readily damaged. In particular, the valve bodies, which are movable pieces, are prone to deform as time goes by, so that the valve bodies no longer overlap, and their initial functionality is lost.

In Patent Document 2, the valve bodies are provided at a flange section, but part of the valve bodies is exposed out of the flange. The structure of the valve bodies themselves is semi-circular, with a small range of motion. Also, not enough consideration is given to the strength of the valve bodies, and hence the valve bodies are damaged as a result of contact from outside against part of the valve bodies, and are likewise damaged readily through repeated opening and closing.

Further, no gap is provided between the artificial nipple and a cap for attaching the artificial nipple to the bottle. In order to lead external air into the bottle, therefore, a gap must be created forcibly by pushing in the base section of the artificial nipple. Doing so is inconvenient in practical use.

Leaking of the beverage held in the bottle upon deformation of the base section of the artificial nipple is an added danger.

Therefore, an aspect of the presently disclosed subject matter includes providing an artificial nipple that includes a check valve that is not readily damaged and does not deform readily even upon repeated opening and closing, that can be prevented from being deformed or damaged by external forces during washing and fitting, and that allows outside air to be reliably led into a bottle, and to provide a nursing container that uses the artificial nipple.

Solution

In accordance with another aspect of the presently disclosed subject matter a molded product made of an elastic material such as a soft resin can be configured as a substantially conical hollow body, and can include: a base section that widens to match an attachment object; an areola section that is formed contiguously to the base section and that extends while narrowing gradually; a nipple section that extends from the areola section and that narrows more than the areola section; and further comprises: a flange section provided in the base section and having a predetermined thickness; and a check valve formed with a valve body so as to be entirely accommodated within a thickness dimension of the flange section.

In the above configuration, the valve body of the check valve is completely accommodated within the thickness of the flange section. Therefore, it is hardly conceivable that something should hit the valve body from outside. Thus, the valve body is not acted upon by an excessive force, in particular during washing. Deformation and damage to the valve body is thus effectively prevented.

The check valve can be configured such that tips of two valve bodies thrust against each other to provide a triangular cross section, thereby forming a slit that opens and closes, and a base end section of each valve body is formed integrally with the flange section.

In the above configuration, the flange section and the base end section of each valve body are formed integrally. As a result, the foregoing are formed at the same time upon molding of the artificial nipple, and a structurally sturdy artificial nipple can be obtained by virtue of such an integral construction in which the base end sections of the valve bodies are not a separate members.

A site at which the base end section of each valve body and the flange section are integrated together can be substantially arc-shaped.

In the above configuration, the base end sections of the integrally-formed valve bodies are shaped as a circular arc. As a result, this allows effectively preventing damage, for instance cuts to the edge portions, and makes for a yet sturdier structure.

The check valve can be configured so as to open and close a slit that is a straight-line opening formed at tips of two valve bodies each formed of a movable piece, and a direction in which the slit extends is a direction that runs perpendicular to a circumferential direction of the flange section, namely, that runs along a radial direction.

By virtue of the above configuration, there is averted a problem wherein the valve bodies of the check valve slip at the site of the slit, which corresponds to the tips of the valve bodies, as a result of which the valve bodies become offset without overlapping, even if a twisting force acts in the circumferential direction when the cap for attaching the artificial nipple to the bottle is fixed to the bottle and is screwed.

Through-holes having a diameter larger than a crevice dimension of the slit can be formed at both end sections of the slit.

The above configuration allows preventing the slit portions of the valve bodies from sticking to each other and from hampering opening thereby. The valve bodies can open and close more reliably as a result.

There can be provided a bulge section that is integrally formed below the areola section, and that bulges outward in a radial direction; and the flange section which opposes an overhang-like lower face of the bulge section, across a constricted section, wherein an inward-facing flange section of a hard cap that is fitted to a bottle for containing a beverage enters into the constricted section such that the cap becomes attached, and a depth of at least part of the constricted section is set to be further back than an inner end of the inward-facing flange section, as a result of which a gap is formed between the part of the constricted section and the cap, and wherein the check valve is provided at a position at which the check valve communicates with the gap.

In the above configuration, external air passes through the gap between the slit and the cap, and through the check valve that communicates with the gap. Therefore, the pressure inside the bottle can be adjusted even without deforming the artificial nipple by manual pushing, as in conventional cases.

In order to attain the above goal, the presently disclosed subject matter is a nursing container comprising an artificial nipple and a bottle to which the artificial nipple is attached, wherein the artificial nipple is a molded product made of an elastic material such as a soft resin and configured overall as a substantially conical hollow body, and comprises: a base section that widens to match an attachment object; an areola section that is formed contiguously to the base section and that extends while narrowing gradually; and a nipple section that extends from the areola section and that narrows more than the areola section, and further comprises: a flange section provided in the base section and having a predetermined thickness; and a check valve formed with a valve body so as to be entirely accommodated within a thickness dimension of the flange section.

Advantageous Effects

As described above, the presently disclosed subject matter succeeds in providing an artificial nipple that is provided with a check valve that is not readily damaged and does not deform readily, even upon repeated opening and closing, and that allows outside air to be reliably led into a bottle, and succeeds in providing a nursing container that uses the artificial nipple.

DESCRIPTION OF EMBODIMENTS

Exemplary embodiments of the presently disclosed subject matter will be explained in detail next based on accompanying drawings.

The embodiments described below are specific examples of the presently disclosed subject matter, and hence involve various technical features. The scope of the disclosed subject matter is in no way limited to these exemplary embodiments.

Figure 1:
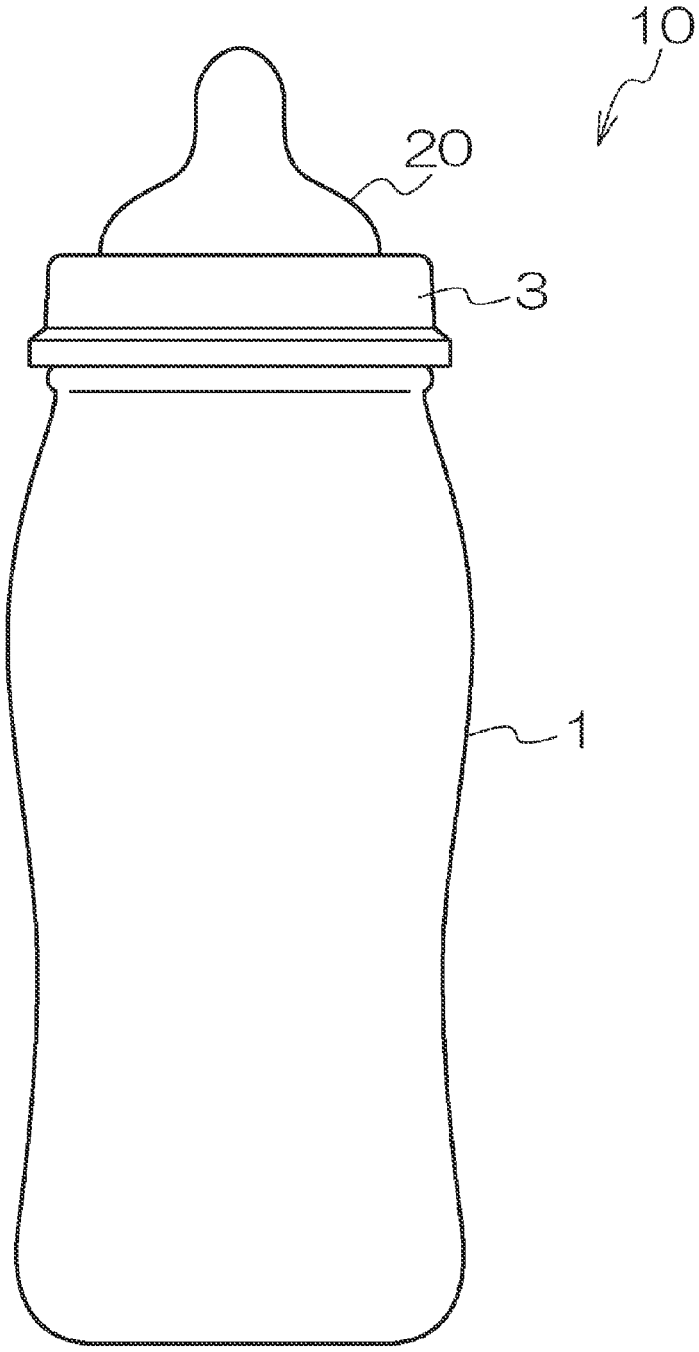
FIG. 1 is a schematic front-view diagram that illustrates the entirety of a nursing container according to an embodiment of the presently disclosed subject matter.

FIG. 1 is a schematic front-view diagram that illustrates the configuration of a nursing container 10 according to an embodiment of the presently disclosed subject matter.

In the figure, the reference numeral 1 denotes a bottle, used in a nursing bottle or the like, as an example of a beverage container.

A male thread, not shown, is formed on the outer periphery of the upper end of the bottle 1, such that the male thread can be screwed to a female thread on the inner face of a cap 3.

A lower end base section of an artificial nipple 20 is fitted into the cap 3 in a below-described manner. In that state, the cap 3 is screwed to the upper end of the bottle 1, to yield thereby an assembled structure.

Figure 2:
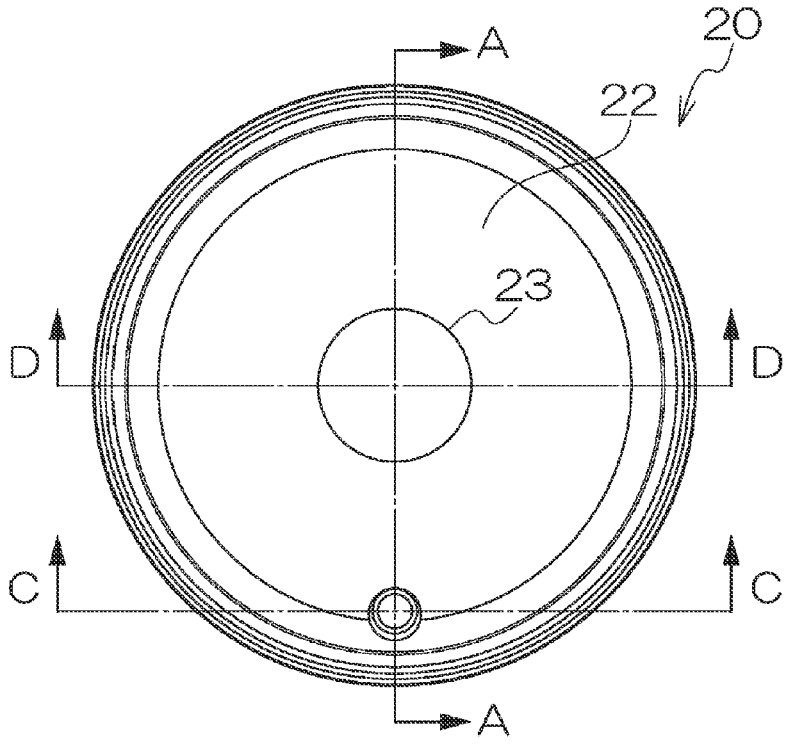
FIG. 2 is a plan-view diagram of a nipple section of the nursing container of FIG. 1.
Figure 4:
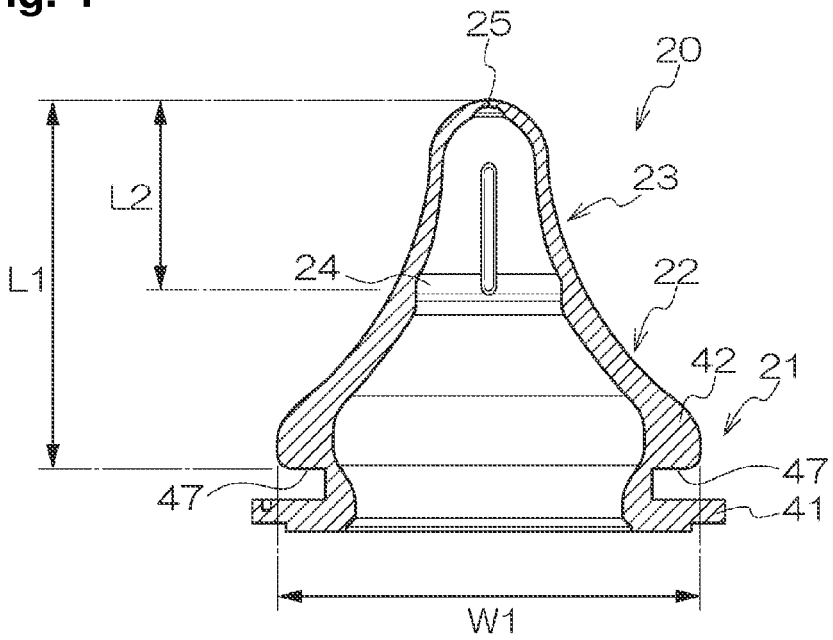
FIG. 4 is a schematic cross-sectional diagram along line D-D in FIG. 2.
Figure 5:
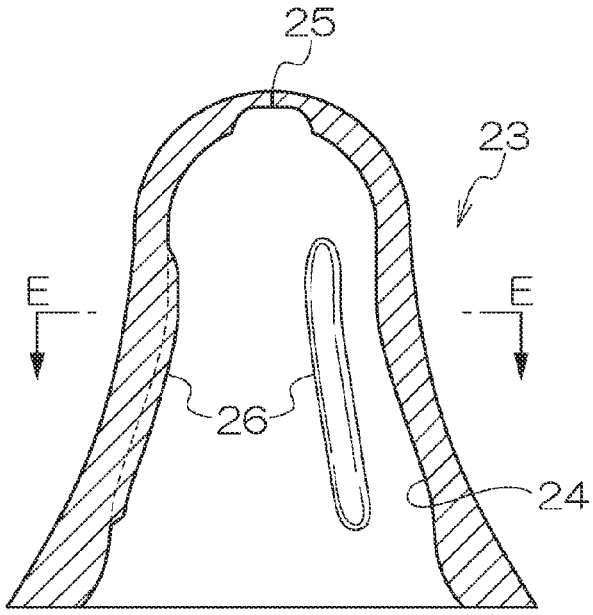
FIG. 5 is an enlarged diagram of the nipple section of FIG. 4.
Figure 6:
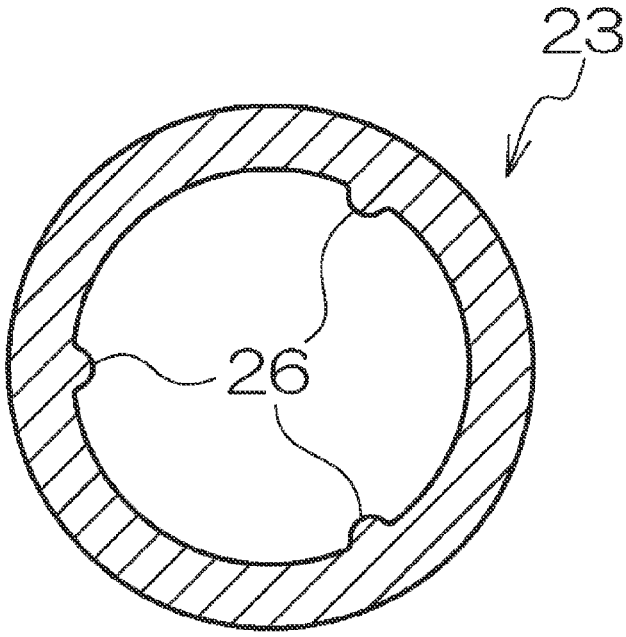
FIG. 6 is a sectional end-view diagram along line E-E of FIG. 5.

FIG. 2 is a schematic plan-view diagram of the artificial nipple 20 of FIG. 1; FIG. 4 is a schematic cross-sectional diagram of D-D in FIG. 2; FIG. 5 is an enlarged diagram of a nipple section in the artificial nipple of FIG. 4; and FIG. 6 is a sectional end-view diagram along E-E of FIG. 5.

As illustrated in FIG. 4, the artificial nipple 20 is molded integrally out of an elastic material such as a soft synthetic resin or the like. As such a material there can be used, for instance, silicone rubber, isoprene rubber, a thermoplastic elastomer, or natural rubber, having a hardness ranging from 10 to 40 (A-type durometer according to JIS-K-6235 (ISO 7619)). Silicone rubber is selected in the present embodiment. Herein there can be used silicone rubber having a hardness ranging from 15 to 35 (A-type durometer according to JIS-K-6235 (ISO 7619)).

The dimensional settings of the nipple section and so forth of the artificial nipple are described further on.

Figure 3A:
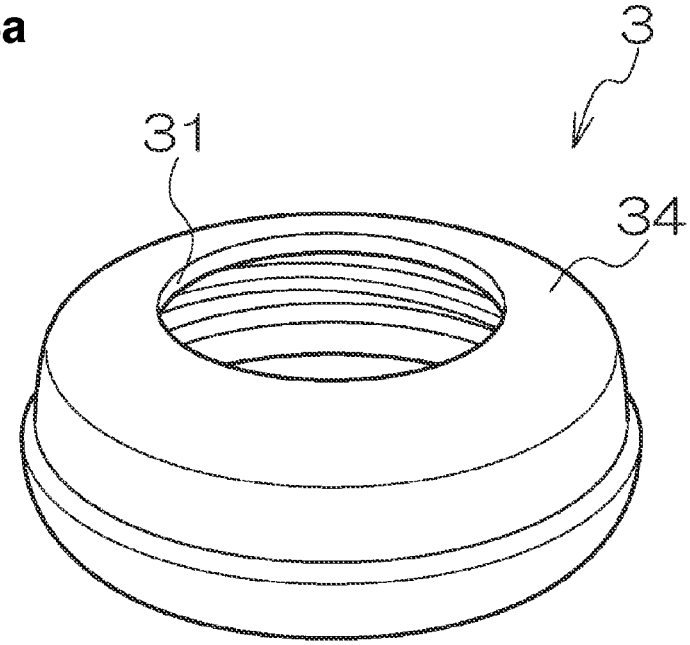
FIG. 3 is a diagram illustrating an example of a cap that is used for connecting a bottle and an artificial nipple in the nursing container of FIG. 1.
Figure 3B:
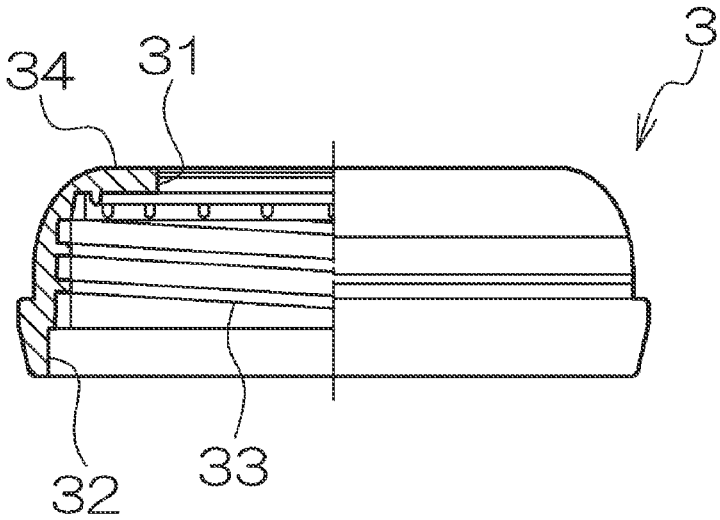

FIG. 3 illustrates an attachment cap (hereafter, "cap") for attaching the artificial nipple 20 to the bottle 1. FIG. 3(*a*) is a schematic perspective-view diagram of the cap 3, and FIG. 3(*b*) is a half-sectional diagram of the cap 3.

Overall, the cap 3 is a flat cylindrical body being molded product of a hard synthetic resin. An upper opening 31 of the flat cylindrical body has a smaller opening diameter than a lower opening 32. A female thread section 33 is formed at an inner-side face of the flat cylindrical body. An inward-facing flange section 34, adjacent to the upper opening 31 and that constitutes a downward stepped-portion, is formed at the upper portion of the cap 3.

The artificial nipple 20 is a molded product, formed of the above-described material, substantially in the form of a conical hollow body overall.

The artificial nipple has a base section 21 that widens so as to match an attachment object, for instance an opening of the bottle 1 of FIG. 1; an areola section 22 that is formed contiguously to the base section 21 and extends while narrowing gradually; and a nipple section 23 that extends from the areola section without widening halfway up to a tip and while narrowing slightly and gradually, at a diameter-narrowing rate that is smaller than the diameter-narrowing rate of the areola section. An opening 25 for discharge of a beverage is formed at the upper end in the figure of the nipple section. The form of the opening 25 can be appropriately selected based on the cut shape thereof, and may be for instance a circular hole, a Y-shape, a cross shape, a single-direction slit or the like.

As illustrated in FIG. 4, the areola section 22 is configured in such a manner that the wall thickness thereof is greater than that of the nipple section 23.

The wall thickness at the boundary between the areola section 22 and the nipple section 23 is smaller than that of the areola section 22 but greater than that of the nipple section 23, so that, as a result, a band-like weakened section 24 is formed along the circumference of that site.

As illustrated in the figure, the wall thickness of the weakened section 24 is large in the vicinity of the areola section 22, but changes gradually in such a manner that the wall thickness is smallest in the vicinity of the nipple section 23.

As a result, the weakened section is highly rigid in the vicinity of the areola section 22, but ever less so the closer it is to the nipple section 23. Deformation (bending) is made thus easier. At sites close to the areola section 22, however, the wall thickness is sufficiently large, and hence the structure is not completely squashed when bent.

The wall thickness of the areola section 22 and of the nipple section 23 is appropriately adjusted depending on the hardness of the material that is used. However, the wall thickness of the nipple section 23 can be set to range from 1.0 mm to 2.5 mm, and the wall thickness of the areola section 22 is set to 1.5 times or more the wall thickness of the nipple section 23.

In the present embodiment, the wall thickness of the nipple section 23 is set to range from 1.5 mm to 2.0 mm, and the wall thickness of the areola section is set to 3.0 mm.

As clearly depicted in FIG. 5 and FIG. 6, ribs that extend in the longitudinal direction are provided on the inner face of the nipple section 23.

In the present embodiment there is formed a plurality of ribs 26. Each rib extends in the longitudinal direction to a same height, such that the lower ends of the ribs overlap the upper portion of the weakened section 24. The ribs are formed at three sites equidistantly along the inner periphery, as illustrated in FIG. 6.

As a result, a gap elicited by the ribs 26 is formed with the inner wall of the nipple section 23, so that passage of a beverage is not hampered upon squashing of the nipple section 23 on account of the pressure of the peristaltic motion under the tongue of the infant during the nursing operation.

Also, providing the ribs 26 on the inner face of the nipple section 23 allows the weakened section 24 to deform (bend) reliably while preventing deformation (bending) of the nipple section 23.

Setting the height (dimension of inward protrusion) of the ribs 26 to be small at the top of FIG. 5, and large at the bottom, makes demolding easier during manufacture, and makes for increased rigidity at the weakest region, i.e. the site of the weakened section 24, so that the passage of the beverage passage is not completely blocked should the weakened section 24 become squashed through bending.

A dimension L2 of the nipple section 23 in a length direction in FIG. 4 is set to be a sufficient length in order for the nipple section 23 to reach the sucking fossa in the mouth cavity of the infant during lactation (ingestion of a beverage other than milk, for instance a juice, will also be referred to hereafter as "lactation").

The sucking fossa stands ordinarily at a position about 10 to 15 mm inward from the lips of the infant, in the mouth cavity.

Therefore, the tip of the nipple section 23 can reach reliably the sucking fossa of the infant if the dimension L2 of the nipple section 23 in the length direction is 15 mm or longer.

In the present example, the dimension L2 of the nipple section 23 in the length direction is set to 15 mm, and a dimension L1 from the lower end of the base section 21 up to the tip of the nipple section 23 is set to 38 mm.

A width W1 of the base section 21 in a radial direction can be 35 mm or more, in order for the areola section 22 to be steadily held by the lips in the infant but without getting into the mouth cavity of the infant, even if the lips of the infant open widely during lactation.

In the present example, the width W1 of the base section 21 in the radial direction is set to 45 mm.

Figure 7:
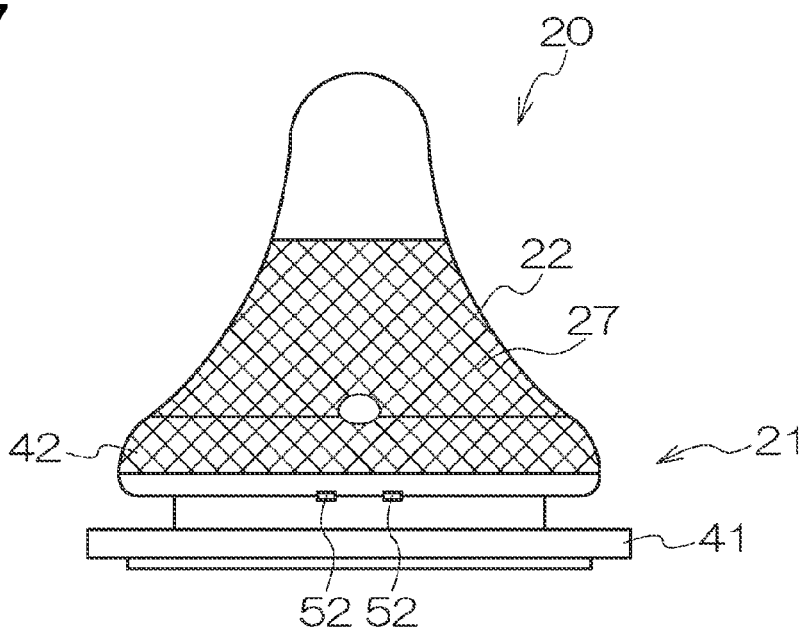
FIG. 7 is a schematic front-view diagram of an artificial nipple in an embodiment.

FIG. 7 is discussed next.

FIG. 7 is a schematic front-view diagram of the artificial nipple 20. The surface of the hatched portion 27 in the areola section 22 in the figure is subjected to fine roughening.

Specifically, the surface is worked to a slightly rough surface.

During the nursing operation of the infant, a result, the areola portion is held steadily, without slipping readily, by the lips of the infant, so that the areola portion can be prevented from coming off the mouth.

Such roughening can be accomplished, for instance, by roughening beforehand, by sandblasting or the like, the inner face of a mold for molding. Alternatively, the entire artificial nipple may be molded, after which the nipple portion is masked and the artificial nipple is processed by sandblasting or the like.

In the present embodiment, as described above, there is provided the areola section 22 that is formed contiguously to the base section 21 and that extends while narrowing gradually; and the nipple section 23 that extends from the areola section 22 without widening halfway up to a tip and while narrowing slightly and gradually, at a diameter-narrowing rate that is smaller than the diameter-narrowing rate of the areola section 22. Also, the nipple section 23 is set to have a length sufficient to reach the sucking fossa in the mouth cavity of the infant during lactation. As a result, it becomes possible to prevent the inconvenience that occurred in conventional artificial nipples, namely push-back of the expanded nipple tip section during peristaltic motion in the nursing operation, in the mouth cavity of the infant; also, the tip of the nipple section 23 can reach, effortlessly and reliably, the sucking fossa, even without stretching of the nipple section 23. Moreover, the nipple section 23 is thin-walled, and hence lactation can take place in the same way as lactation from the mother's nipple, through squashing of the nipple section 23 in a state of having reached the sucking fossa.

Providing the weakened section 24 allows the nipple section 23 to point towards the sucking fossa, through bending (but without collapsing), and allows the region that becomes squashed when acted upon by the peristaltic motion to be limited to the nipple section 23, without extending to the areola section 22. As a result, although the areola section deforms somewhat accompanying the motion of the lips of the infant, the areola section can be nonetheless held steadily by the lips, without being squashed.

The base section 21 of the artificial nipple 20 of FIG. 4 is explained next.

The base section 21 is provided with: a bulge section 42 that bulges outward in the radial direction, below the areola section 22 and around the whole circumference; an overhang section 47 that is formed on the lower face of the bulge section; and a flange section 41 that opposes the overhang section 47, such that the flange section 41 has a predetermined thickness and bulges outwards, for instance in the form of a ring, around the whole circumference, at the lower end of the artificial nipple 20.

The region of the base section 21 is configured in a characteristic manner.

Figure 8:
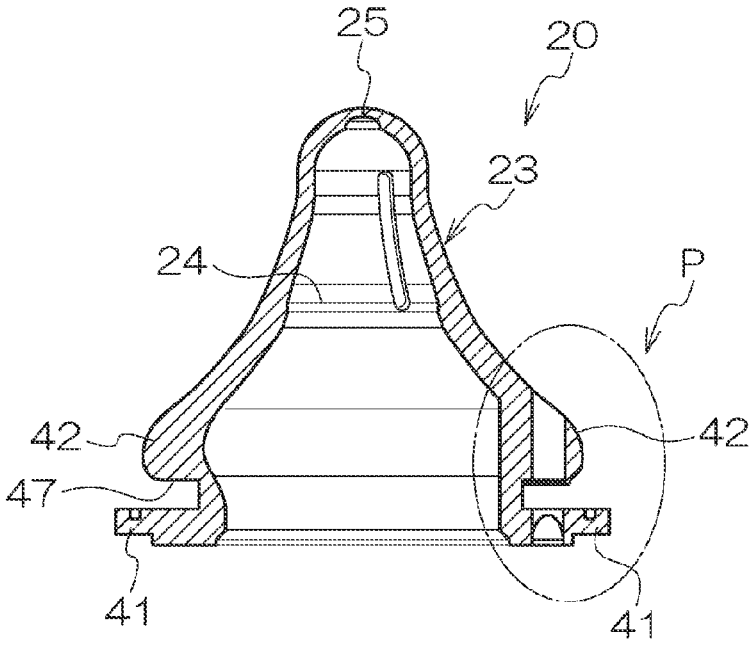
FIG. 8 is a schematic cross-sectional diagram along line A-A in FIG. 2.
Figure 9:
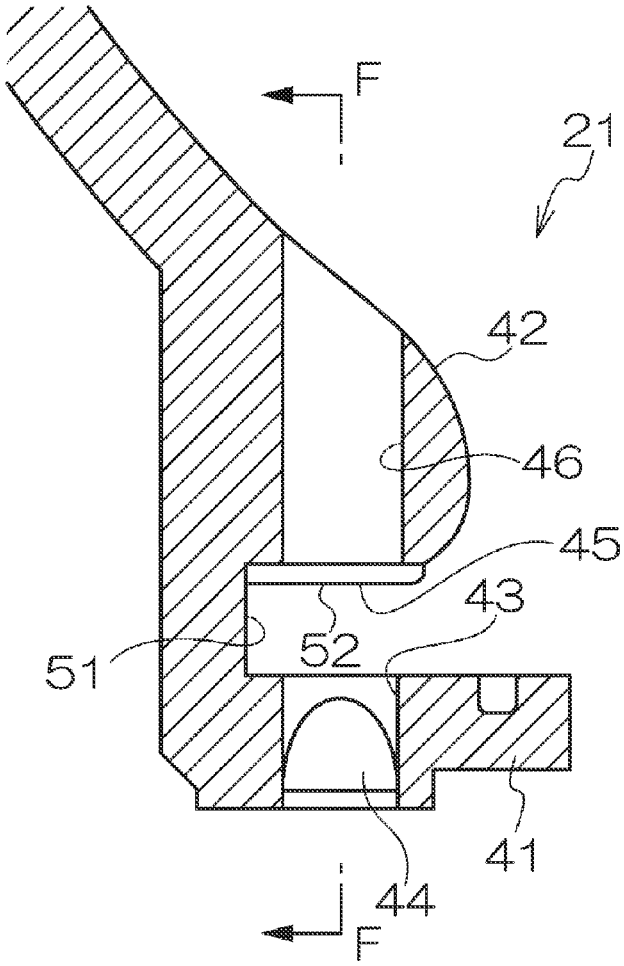
FIG. 9 is a partial enlarged cross-sectional diagram of FIG. 8.
Figure 10:
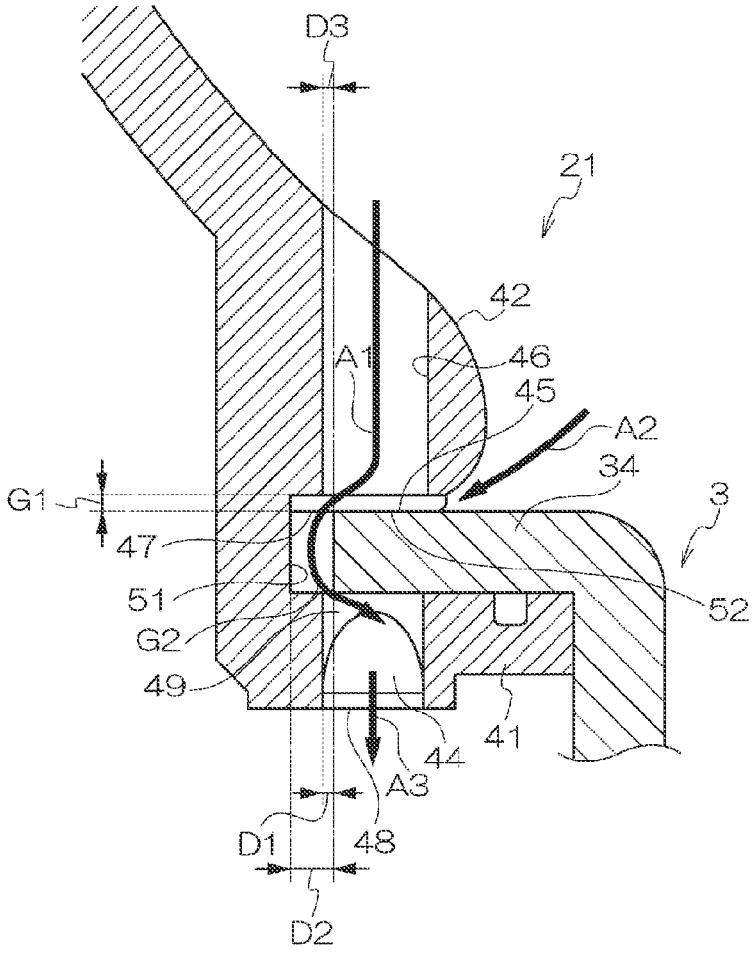
FIG. 10 is a partial enlarged cross-sectional diagram of a junction portion of an artificial nipple and a cap.

FIG. 8 is a cross-sectional diagram of A-A in FIG. 2. FIG. 9 is an enlarged partial cross-sectional diagram illustrating an enlargement of the region denoted by a reference symbol P in FIG. 8. FIG. 10 is an enlarged partial cross-sectional diagram of a portion of FIG. 9 with the cap 3 in a fitted state.

In FIG. 8, FIG. 9 and FIG. 10, the bulge section 42 is provided as corresponding to a considerably widening portion that is contiguous to the swelling of the breast, from the areola section 22.

Between the bulge section 42 and the flange section 41 there is formed a constricted section 51, comprising a groove or slit having a dimension such that the inward-facing flange section 34 explained in FIG. 3(*b*) gets into the groove or slit.

Herein, it is particularly important that at least part of the constricted section 51 be provided in a deeply recessed manner. As made clear in FIG. 10, the constricted section 51 is formed so as to reach a position deeper than the penetration depth of the flange section 34 of the cap 3.

Specifically, the constricted section 51 is formed to be deeper, by a dimension D2, than the inner end of a flange section 34 of the cap 3 upon fitting of the flange section 34 of the cap 3 into the constricted section 51.

In the flange section 41 there is provided a check valve 44 that closes up when external air would be taken in, and liquid would escape from the interior, upon a drop of inner pressure of the bottle 1 as a result of suction of milk or the like from inside the bottle 1, during lactation, in a state where the artificial nipple 20 is attached to the bottle 1 by way of the cap 3, i.e. the state of FIG. 1.

The check valve 44 is formed in such a way so as to be accommodated within the thickness of the flange 41, without protruding beyond the top face or the lower face of the flange 41.

Figure 11:
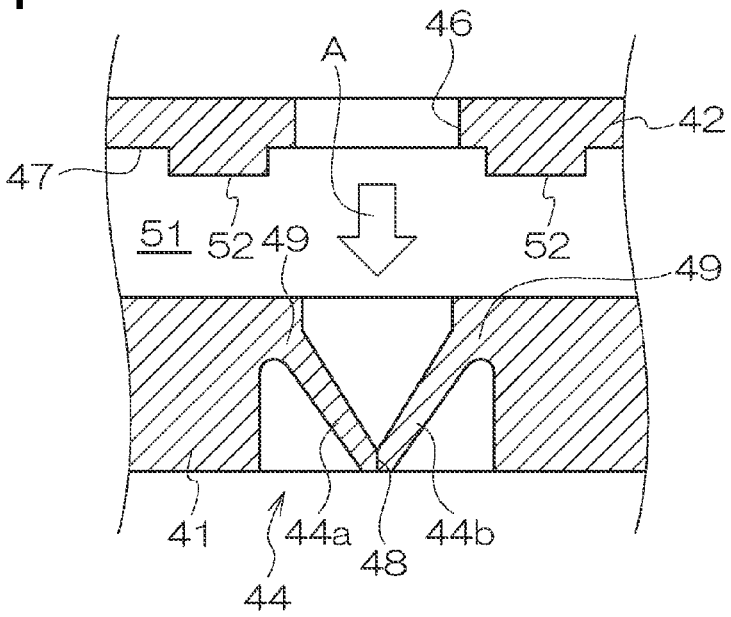
FIG. 11 is a schematic cross-sectional diagram along line F-F in FIG. 9.
Figure 13:
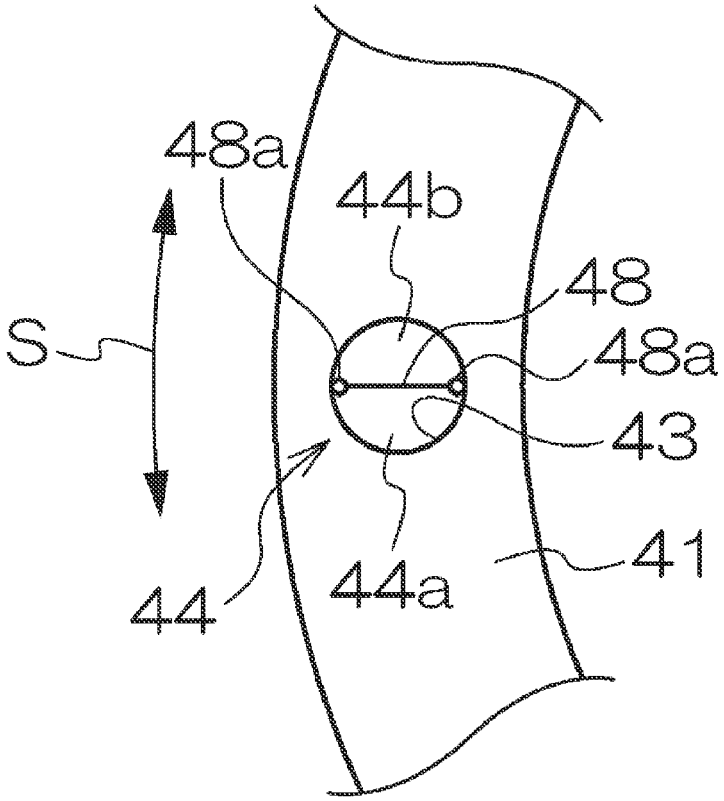
FIG. 13 is an explanatory diagram illustrating the direction of a flange and a slit in the valve bodies of FIG. 11.

Specifically, a circular formation site 43, for instance such as the one illustrated in FIG. 13, is provided at a predetermined region of the flange section 41. Further, integral sections 49, the base end sections whereof are integral with the flange section 41, are provided, as illustrated in FIG. 11, such that valve bodies 44*a*, 44*b*, being thin-walled movable pieces, are formed facing obliquely downward from the integral sections 49, and such that respective tips of the valve bodies 44*a*, 44*b* (lower ends in FIG. 11) close up, to prevent thereby liquid from leaking, while air coming in the direction of arrow A causes the abovementioned tips to open, on account of air pressure, and to form a slit 48 through which the air flows into the bottle 1.

Figure 12:
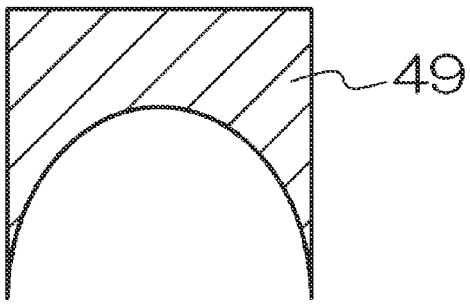
FIG. 12 is a diagram illustrating the shape of a junction portion of valve bodies in FIG. 11.

The integral sections 49, the roots whereof are shaped as crescent-like arcs, as denoted by the hatching in FIG. 12, are integrally molded with the valve bodies 44*a*, 44*b*, which are respective movable pieces.

That is, the check valve 44 is configured such that the tips of the two valve bodies 44*a*, 44*b* thrust against each other to provide a triangular cross section, thereby forming the slit 48 that opens and closes. The base end sections (integral sections 49) of the valve body are formed integrally with the flange section of the base section having a substantially crescent shape.

As illustrated in FIG. 13, the slit 48, which is an opening of the check valve 44, is a straight-line opening that is formed in a direction perpendicular to a circumferential direction S of the flange section 41. As a result, there is averted a problem wherein the tips (at the site of the slit 48) of the valve bodies 44*a*, 44*b* slip, even if a twisting force acts in the circumferential direction S, when the artificial nipple 20 attached to the cap 3 is fitted onto the bottle 1 and the cap 3 is screwed.

Through-holes having a diameter that is larger than a crevice dimension of the slit are formed at both end sections of the slit. Specifically, it is possible to provide circular through-holes 48*a* at both end sections of the slit 48. Doing so allows preventing the portions of the valve bodies at the slit 48 from sticking to each other and from hampering opening thereby. The valve bodies can open and close more reliably as a result.

Therefore, the through-holes 48*a* may be circular, as in the figure, or may have any shape, for instance triangular, so long as the holes elicit a similar effect.

As FIG. 10 shows, the outer edge (inner end) of the formation site 43 of the check valve 44 stands slightly further inward (further back) than the inner end of the fitted cap 34, so that a gap D1 can be formed as a result.

As illustrated in FIG. 10, a through-hole 46 running up and down is formed in the bulge section 42, at a position immediately above the check valve 44. The inner end of the through-hole 46 stands slightly further inward (further back) than the inner end of the fitted cap 34, so that a gap D3 can be formed as a result.

Spacers 52 can be formed at the overhang section 47 of the bulge section 42, in the vicinity of the check valve 44, the spacers 52 being in the form of a protrusion or the like that is slightly thicker on two flanking sides of the through-hole 46, as can be appreciated in FIG. 7 and FIG. 11. These spacers 52, 52 constitute a gap G1 of FIG. 11.

In the embodiment having the above-described configuration, external air passes through the through-hole 46 of the bulge section 42, through the gap D1, and next through the gaps D1, D2, to reach the check valve 44, as indicated by arrow A1 of FIG. 10, upon a drop in the inner pressure of the bottle 1 during lactation. In FIG. 11, the lower ends of the valve bodies 44*a*, 44*b* of the check valve 44 open up, and air flows into the bottle 1, through the slit 48, as indicated by arrow A3 in FIG. 10. Therefore, the artificial nipple 20 does not collapse even upon a drop in the inner pressure of the bottle 1, and lactation can continue without hindrance.

Even if the through-hole 46 should become blocked by the lips of the infant on account of a change in the position at which the infant sucks on the artificial nipple 20 during lactation, the resulting drop in the inner pressure of the bottle 1 can be effectively prevented through inflow of external air through the gap G1, as indicated by arrow A2, thanks to the presence of the spacers 52.

The presently disclosed subject matter is not limited to the above-described embodiments.

As the case may require, the features of the above embodiments and variations may be omitted or combined with other features that have not been explained.

REFERENCE SIGNS LIST

20: artificial nipple; 22: areola section; 23: nipple section; 24: weakened section; 34: flange section (of cap); 41: flange section; 42: bulge section; 44: check valve; 48: slit; 51: constricted section; 52: spacer; D1, D2, D3, G1 G2: gap.

The invention claimed is:

1. An artificial nipple, which is a molded product made of an elastic material and configured as a substantially conical hollow body, the artificial nipple comprising:

a base section that widens to match an attachment object;

an areola section formed contiguously to the base section and that extends while narrowing gradually;

a nipple section that extends from the areola section and that narrows more than the areola section;

a flange section provided in the base section and having a predetermined thickness; and a check valve formed with a valve body so as to be entirely accommodated within a thickness dimension of the flange section, wherein the areola section includes a bulge section having an opening therein, the opening being in fluid communication with the check valve such that air can pass through the check valve via the opening.

2. An artificial nipple, which is a molded product made of an elastic material and configured as a substantially conical hollow body, the artificial nipple comprising:

a base section that widens to match an attachment object;

an areola section formed contiguously to the base section and that extends while narrowing gradually;

a nipple section that extends from the areola section and that narrows more than the areola section;

a flange section provided in the base section and having a predetermined thickness; and a check valve formed with a valve body so as to be entirely accommodated within a thickness dimension of the flange section, wherein the check valve is configured such that tips of two valve bodies thrust against each other to provide a triangular cross section, thereby forming a slit that opens and closes, and a base end section of each valve body is formed integrally with the flange section.

3. The artificial nipple according to claim 2, wherein through-holes having a diameter that is larger than a crevice dimension of the slit are formed at both end sections of the slit.

4. The artificial nipple according to claim 2, wherein a site at which the base end section of each valve body and the flange section are integrated together is substantially arc-shaped.

5. The artificial nipple according to claim 1, wherein the check valve is configured so as to open and close a slit that is a straight-line opening formed at tips of two valve bodies each formed of a movable piece, and a direction in which the slit extends is a direction that runs perpendicular to a circumferential direction of the flange section.

6. The artificial nipple according to claim 1, wherein the bulge section is integrally formed below the areola section, and bulges outward in a radial direction and a lower surface of the bulge section overhangs the flange section, wherein an inward-facing flange section of a hard cap that is fitted to a bottle for containing a beverage enters into the constricted section such that the cap becomes attached, and a depth of at least part of the constricted section is set to be further back than an inner end of the inward-facing flange section, as a result of which a gap is formed between the part of the constricted section and the cap, and wherein the check valve is provided at a position at which the check valve communicates with the gap.

7. A nursing container comprising an artificial nipple and a bottle to which the artificial nipple is attached, wherein the artificial nipple is a molded product made of an elastic material and configured as a substantially conical hollow body, and comprises:

a base section that widens to match an attachment object;

an areola section that is formed contiguously to the base section and that extends while narrowing gradually;

a nipple section that extends from the areola section and that narrows more than the areola section;

a flange section provided in the base section and having a predetermined thickness; and a check valve formed with a valve body so as to be entirely accommodated within a thickness dimension of the flange section, wherein the areola section includes a bulge section extending over the check valve and having an opening therein located directly above the check valve.

8. The artificial nipple according to claim 3, wherein a site at which the base end section of each valve body and the flange section are integrated together is substantially arc-shaped.

9. The artificial nipple according to claim 2, wherein the check valve is configured so as to open and close a slit that is a straight-line opening formed at tips of two valve bodies each formed of a movable piece, and a direction in which the slit extends is a direction that runs perpendicular to a circumferential direction of the flange section.

10. The artificial nipple according to claim 3, wherein the check valve is configured so as to open and close a slit that is a straight-line opening formed at tips of two valve bodies each formed of a movable piece, and a direction in which the slit extends is a direction that runs perpendicular to a circumferential direction of the flange section.

11. The artificial nipple according to claim 4, wherein the check valve is configured so as to open and close a slit that is a straight-line opening formed at tips of two valve bodies each formed of a movable piece, and a direction in which the slit extends is a direction that runs perpendicular to a circumferential direction of the flange section.

12. The artificial nipple according to claim 2, wherein the bulge section is integrally formed below the areola section, and bulges outward in a radial direction and a lower surface of the bulge section overhangs the flange section, across a constricted section, wherein an inward-facing flange section of a hard cap that is fitted to a bottle for containing a beverage enters into the constricted section such that the cap becomes attached, and a depth of at least part of the constricted section is set to be further back than an inner end of the inward-facing flange section, as a result of which a gap is formed between the part of the constricted section and the cap, and wherein the check valve is provided at a position at which the check valve communicates with the gap.

13. The artificial nipple according to claim 3, wherein the bulge section is integrally formed below the areola section, and bulges outward in a radial direction and a lower surface of the bulge section overhangs the flange section, across a constricted section, wherein an inward-facing flange section of a hard cap that is fitted to a bottle for containing a beverage enters into the constricted section such that the cap becomes attached, and a depth of at least part of the constricted section is set to be further back than an inner end of the inward-facing flange section, as a result of which a gap is formed between the part of the constricted section and the cap, and wherein the check valve is provided at a position at which the check valve communicates with the gap.

14. The artificial nipple according to claim 4, wherein the bulge section is integrally formed below the areola section, and bulges outward in a radial direction and a lower surface of the bulge section overhangs the flange section, across a constricted section, wherein an inward-facing flange section of a hard cap that is fitted to a bottle for containing a beverage enters into the constricted section such that the cap becomes attached, and a depth of at least part of the constricted section is set to be further back than an inner end of the inward-facing flange section, as a result of which a gap is formed between the part of the constricted section and the cap, and wherein the check valve is provided at a position at which the check valve communicates with the gap.

15. The artificial nipple according to claim 5, wherein the bulge section is integrally formed below the areola section, and bulges outward in a radial direction and a lower surface of the bulge section overhangs the flange section, across a constricted section, wherein an inward-facing flange section of a hard cap that is fitted to a bottle for containing a beverage enters into the constricted section such that the cap becomes attached, and a depth of at least part of the constricted section is set to be further back than an inner end of the inward-facing flange section, as a result of which a gap is formed between the part of the constricted section and the cap, and wherein the check valve is provided at a position at which the check valve communicates with the gap.

16. The artificial nipple according to claim 7, wherein the artificial nipple is made of a soft resin.

17. The artificial nipple according to claim 1, wherein the artificial nipple is made of a soft resin.

18. A nursing container comprising an artificial nipple and a bottle to which the artificial nipple is attached, wherein the artificial nipple is a molded product made of an elastic material and configured as a substantially conical hollow body, and comprises:

a base section that widens to match an attachment object;

an areola section formed contiguously to the base section and that extends while narrowing gradually;

a nipple section that extends from the areola section and that narrows more than the areola section;

a flange section provided in the base section and having a predetermined thickness; and a check valve formed with a valve body so as to be entirely accommodated within a thickness dimension of the flange section, wherein the check valve is configured such that tips of two valve bodies thrust against each other to provide a triangular cross section, thereby forming a slit that opens and closes, and a base end section of each valve body is formed integrally with the flange section.

* * * * *